US007575295B2

(12) United States Patent
Lee

(10) Patent No.: US 7,575,295 B2
(45) Date of Patent: Aug. 18, 2009

(54) INK JET DEVICE AND METHOD OF CLEANING IT

(75) Inventor: Myoung Ho Lee, Anyang-si (KR)

(73) Assignee: LG Display Co., Ltd., Seoul (KR)

( * ) Notice: Subject to any disclaimer, the term of this patent is extended or adjusted under 35 U.S.C. 154(b) by 479 days.

(21) Appl. No.: 11/452,383

(22) Filed: Jun. 14, 2006

(65) Prior Publication Data

US 2007/0103502 A1 May 10, 2007

(30) Foreign Application Priority Data

Nov. 10, 2005 (KR) ..... 10-2005-0107630

(51) Int. Cl.
*B41J 2/165* (2006.01)

(52) U.S. Cl. ..... 347/28

(58) Field of Classification Search ..... 347/28, 347/29, 30, 32

See application file for complete search history.

(56) References Cited

U.S. PATENT DOCUMENTS 4,296,418 A * 10/1981 Yamazaki et al. ..... 347/28
5,495,272 A * 2/1996 Yamaguchi ..... 347/28

FOREIGN PATENT DOCUMENTS

JP 62-090253 4/1987

* cited by examiner

*Primary Examiner*—Shih-wen Hsieh
(74) *Attorney, Agent, or Firm*—McKenna Long & Aldridge

(57) ABSTRACT

This invention relates to an ink jet device that is adaptive for preventing formation of a bad pattern as well as improving the life span of the ink jet device. An ink jet device according to an embodiment of the present invention includes: a maintaining/repairing stage filled with cleaning water; a plurality of nozzles to be submerged into the maintaining/repairing stage filled with the cleaning water; a plurality of chambers connected to the nozzles in a one-to-one relationship, wherein a volume of each chamber is variable by a pressing means; a supply tube that supplies a discharged material; a discharging tube that discharges a contaminant and the cleaning water from at least one of the nozzle and the chamber; a collecting and delivering part connected to the supply tube, the discharging tube and the chambers that supplies the discharged material from the supply tube to the chambers and supplying the contaminant and the cleaning water from the chambers to the discharging tube; and a pump connected to the discharging tube that pumps the contaminant and the cleaning water to the discharging tube.

13 Claims, 3 Drawing Sheets

INK JET DEVICE AND METHOD OF CLEANING IT

This application claims the benefit of Korean Patent Application No. P2005-0107630, filed on Nov. 10, 2005, which is hereby incorporated by reference for all purposes as if fully set forth herein.

BACKGROUND OF THE INVENTION

1. Field of the Invention

The present invention relates to an ink jet device, and more particularly to an ink jet device that prevents the formation of bad ink patterns as well as improving the life span of the ink jet device.

2. Description of the Related Art

An ink jet device is a printing device that sprays ink through a plurality of nozzles by pressing the ink using a piezoelectric device or a heater, thereby printing a letter or picture on a printing paper. The ink jet device sprays ink, including dye ink, organic pigment, or carbon black through the nozzle in order to print a letter or picture while operating a printing head having a plurality of nozzles, thereby forming a minute dot in a paper. And, a set of minute dots records the letter or picture on the paper.

Recently, it has been proposed to form wire lines and a spacer for a liquid crystal display panel by use of the ink jet device, especially, an ink jet device that uses a piezoelectric device that sends out ink and does not require a heating process.

Further, the ink jet device that forms the wire line, spacer, etc. of the flat panel display panel forms the wire line and spacer by spraying material such as minute metal particles for the wire line and ball spacers for the spacers of the flat panel display panel. The discharged material includes solvent besides the minute metal particles and ball spacers that are the materials for forming the patterns of the wire line and spacer. The material for forming the patterns is mixed into the solvent, thereby being sprayed through the ink jet device.

In the case where the material for forming the patterns is the minute metal particle, the discharged matter of the ink jet device is composed of the mixture of the solvent and the minute metal particle of 1-100 nm. In the case where the material for forming the patterns is the ball spacer, the discharged material of the ink jet device is composed of the mixture of the solvent and the ball spacer of 10 μm or less. To describe more specifically about the discharged material for forming the spacer, the ball spacer is made from a material of polystyrene, etc of 3-15 μm in diameter, and the solvent mixed with the ball spacer may include water, IPA (isopropyl alcohol), glycerol, etc.

The discharged material is sprayed through the nozzles, thereby producing a desired pattern. The desired pattern is directed by a host computer (not shown) included in the ink jet device.

FIG. 1 is a diagram briefly representing ink jet device of the related art, and an area 'A' of FIG. 1 is illustrated for explaining an ink jet head more specifically.

Referring to FIG. 1, the ink jet device for spraying the minute metal particles or the ball spacers includes an ink jet head 1 having a plurality of nozzles 9 that discharges a material, and a storing part 11 that stores the discharged material.

Further, the ink jet device further includes: a pump 13 and a circulation path 23 that are formed between the storing part 11 and the ink jet head 1 in order to prevent precipitation and cohesion of the ball spacers or the minute metal particles of the discharged material stored at the storing part 11; first to third supply tubes 21, 22, 24 providing a passage through which the discharged material or cleaning water is supplied; a cleaning water supplier 15 that supplies the cleaning water for cleaning impurities or the precipitated minute particles of the inner part of the supply tube or the ink jet head part 1; a discharging part 17 for sending out the cleaning water including the precipitated minute particles; and first and second valves 31, 33 for controlling the flow of the cleaning water or the discharged material between the first to third supply tubes 21, 22, 24.

The storing part 11 acts to store the discharged material for the pattern to be formed.

The storing part 11 is connected to the first supply tube 21 that provides a passage through which the discharged material may move, and the first supply tube 21 has the second valve 33 that determines whether or not the discharged material is discharged through the head part 1.

The discharged material stored at the storing part 11 moves to the ink jet head 1 along the first supply tube 21 and the third supply tube 24 that connects the first supply tube 21 and the ink jet head 1 when only the second valve 33 is opened.

The ink jet head 1 further includes a collecting and delivering part 3 connected to the third supply tube 24 to accumulate the discharged material supplied from the storing part 11; a plurality of chambers 5 connected to the collecting and delivering part 3 to receive the discharged material accumulated at the collecting and delivering part 3; and a plurality of nozzles 9 connected to a plurality of chambers 5 to form a pattern by spraying the discharged material.

The collecting and delivering part 3 acts to send out the discharged material transmitted from the third supply tube 24.

The chambers 5 act to cause the discharged material supplied from the collecting and delivering part 3 to be sprayed through the nozzle 9. The piezoelectric device is adjacent to each of the chambers 5 in order to spray the discharged material through the nozzle 9. Each of the piezoelectric devices is controlled by a host computer. In the ink jet device, when the piezoelectric device operates according to the control signal of the host computer, pressure is applied to the inside of the chamber 5, and the discharged material inside of the chamber 5 is sprayed through the nozzle 9 by the pressure. The ink jet device may form a desired pattern through the sprayed discharged material, and the operation of the piezoelectric device is controlled in accordance with the desired pattern.

On the other hand, the discharged material stored at the storing part 11 includes minute particles such as minute metal particles or ball spacers, thus if a long time lapses, the minute particles included in the discharged material might be precipitated or cohered. In order to prevent the precipitation and cohesion of the minute particles, the circulation path 23. and the pump 13 are connected between the first supply tube 21 and the storing part 11.

The circulation path 23 is a stirring means which makes it possible for the discharged material stored at the storing part 11 to flow all the time. The minute particles included in the discharged material are prevented from precipitating or cohering by the circulation path 23 acting as a stirring means.

The pump 13 acts to provide a driving force to the discharge material so that the discharged material stored at the storing part 11 moves through the circulation path 23.

Further, when using the ink jet device for a long time, the inside of the head part 1 may be contaminated with the precipitation, cohesion, adherence, etc. of the minute particles included in the discharged material. In order to remove the contaminant, an operator first closes the second valve 33 of the ink jet device and impedes the supply of the discharged material. Then, the operator opens the first valve 31 connected to the cleaning water supplier 15 so that the cleaning water can flow through the second supply tube 22 connected to the first valve 31 and the third supply tube 24 connected to the second supply tube 22. The cleaning water is discharged to the outside by flowing along the collecting and delivering part 3 connected to the third supply tube 24, the chamber 5 connected to the collecting and delivering part 3, and the nozzle 9 connected to the chamber 5 through the third supply tube 24. In this way, the cleaning water discharges the contaminant inside the head part 1 as the cleaning water is discharged to the outside through the head part 1.

In order to make the discharge of the contaminant more effective, the ink jet device might further include a discharging part 17 including a discharging tube 25 connected to the head part 1 and a third valve 35 connected to the discharging tube 25.

As described above, the ink jet device may eliminate the contaminant inside of the head part 1 by the cleaning water. The cleaning water flows by hydraulic pressure in the cleaning water supplier 15 to remove the contaminant. However, the hydraulic pressure applied to the cleaning water supplier 15 might damage the head part 1, thus the strength of pressure that may be applied to the cleaning water supplier 15 is limited. Further, the pressure applied to the cleaning water supplier 15 can push out the contaminant only in a direction that the discharged material is sprayed. Because of the fact that the pressure applied for cleaning the head part 1 is provide only in the one direction that the discharged material is sprayed and that the strength is limited, the contaminant P resides behind at the corner inside of the chamber 5 and the collecting and delivering part 3. There is a problem because the remaining contaminant P, when being left alone for a long time, causes the head part 1 to clog, thus shortening the life span of the ink jet device and then forming a bad pattern.

SUMMARY OF THE INVENTION

Accordingly, the present invention is directed to an ink jet device that substantially obviates one or more of the problems due to limitations and disadvantages of the related art.

An advantage of the present invention is to provide an jet device that is adaptive for preventing formation of a bad pattern as well as improving the life span of the ink jet device.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve these and other objects of the invention, an ink jet device according to an aspect of the present invention includes: a maintaining/repairing stage filled with cleaning water; a plurality of nozzles to be submerged into the maintaining/repairing stage filled with the cleaning water; a plurality of chambers connected to the nozzles in a one-to-one relationship, wherein a volume of each chamber is variable by a pressing means; a supply tube that supplies a discharged material; a discharging tube that discharges a contaminant and the cleaning water from at least one of the nozzle and the chamber; a collecting and delivering part connected to the supply tube, the discharging tube and the chambers that supplies the discharged material from the supply tube to the chambers and supplying the contaminant and the cleaning water from the chambers to the discharging tube; and a pump connected to the discharging tube that pumps the contaminant and the cleaning water to the discharging tube.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

Figure 1:
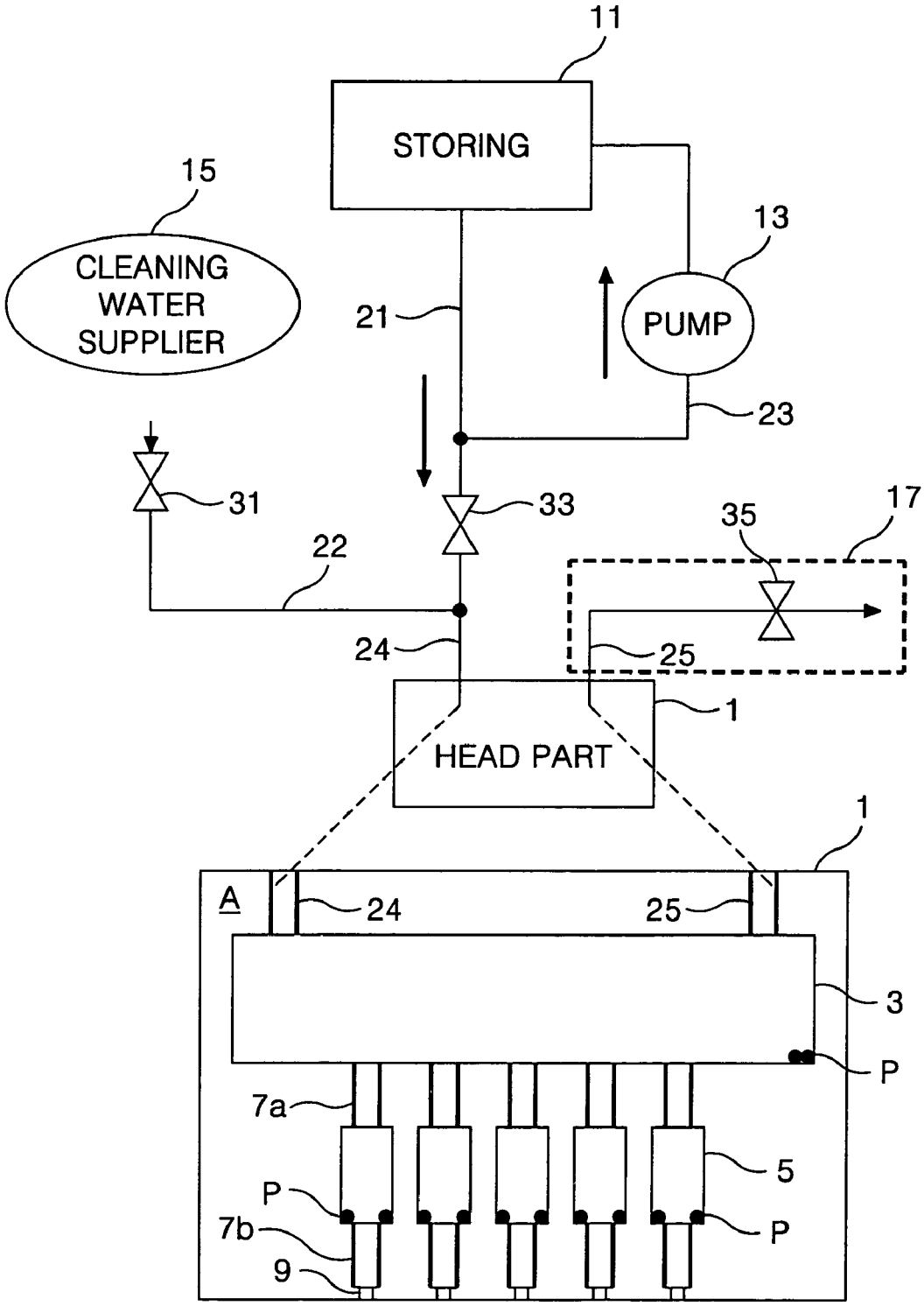
FIG. 1 RELATED ART
FIG. 1 is a diagram briefly representing ink jet device of the related art.
Figure 2:
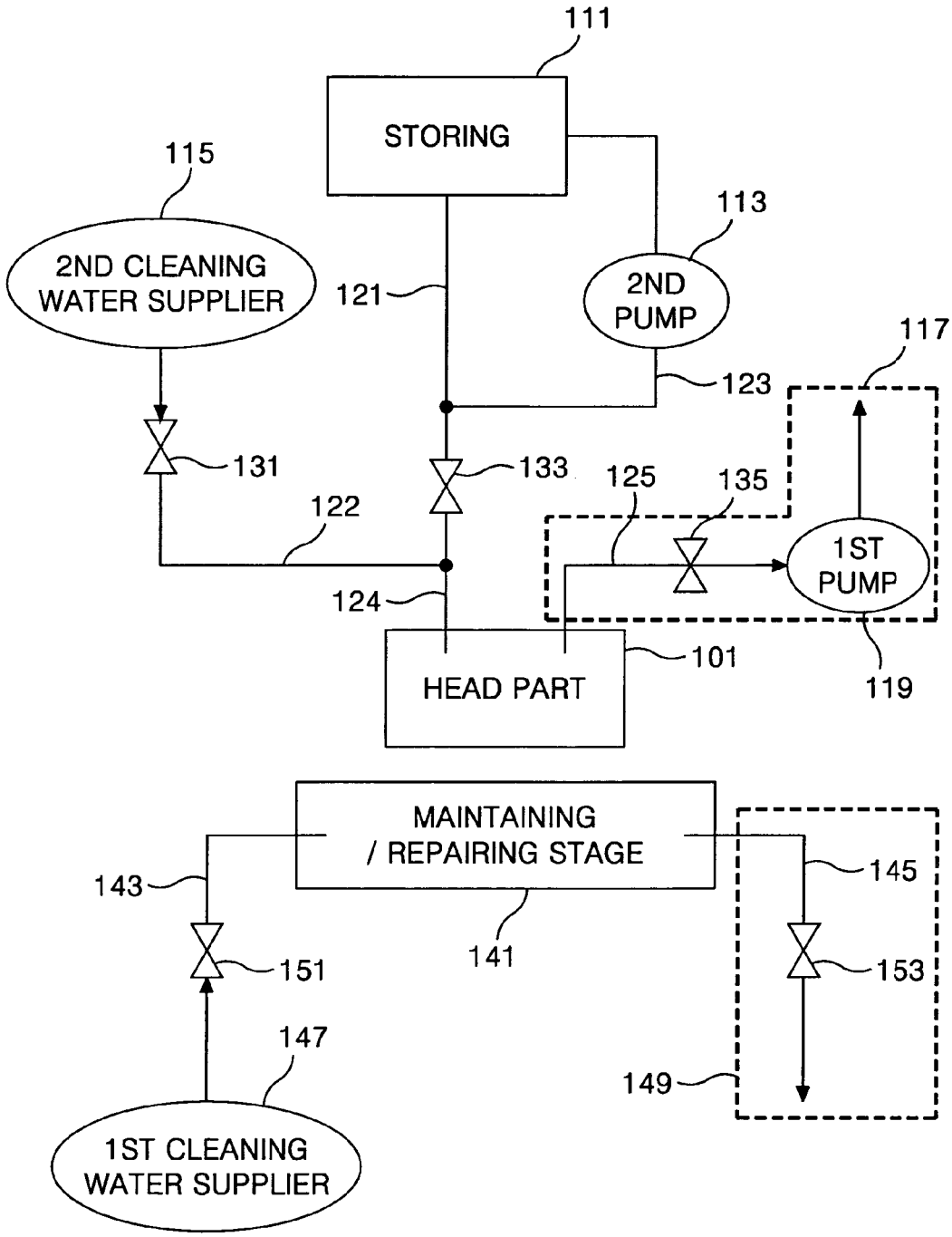
FIG. 2 is a diagram briefly representing ink jet device according to the present invention.
Figure 3:
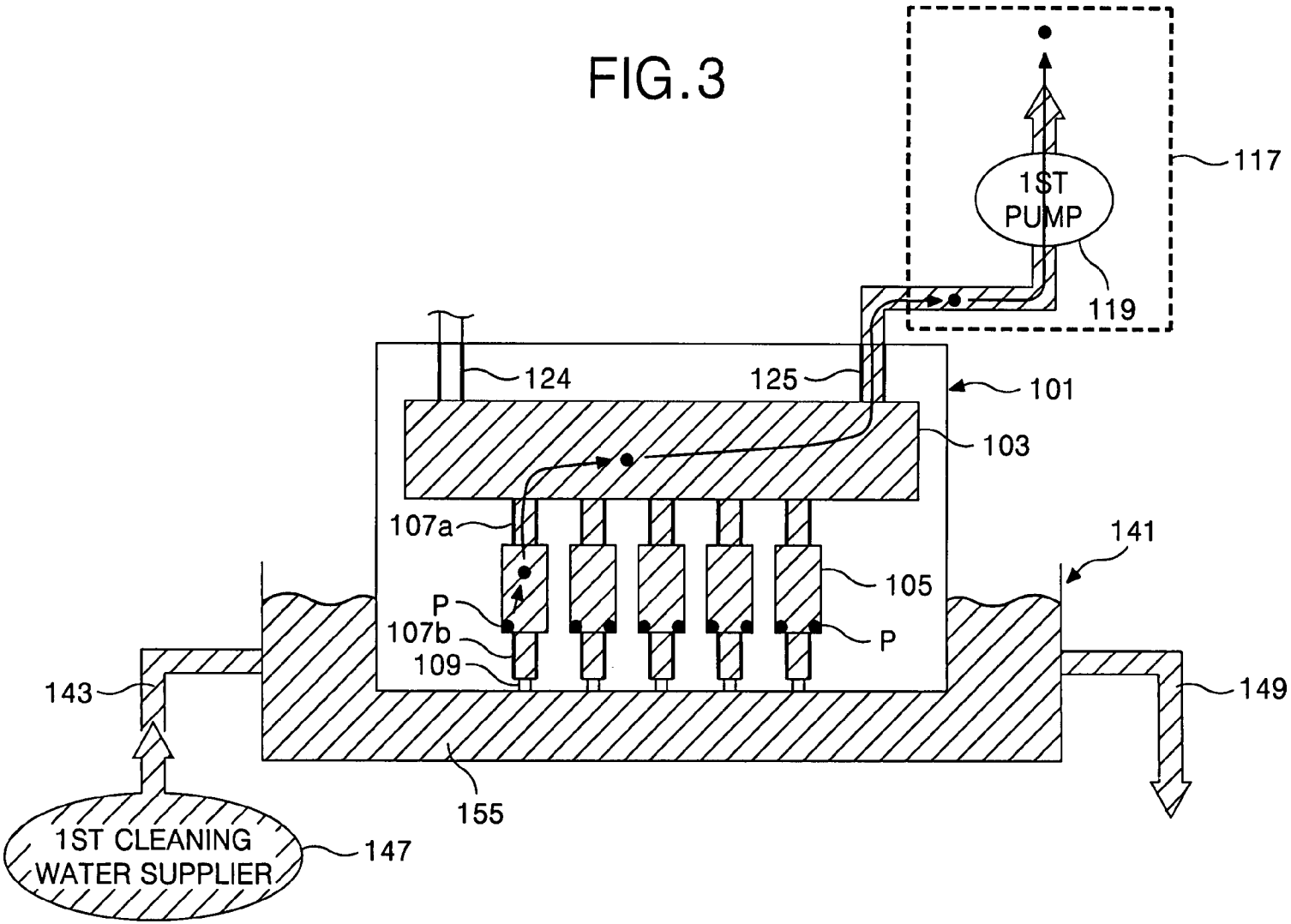
FIG. 3 is a diagram representing a part of the ink jet device shown in FIG. 2.

With reference to FIGS. 2 and 3, embodiments of the present invention will be explained as follows.

FIG. 2 is a diagram briefly representing an ink jet device according to the present invention.

Referring to FIG. 2, the ink jet device according to the present invention sends out a discharged material that is a mixture where minute particles are mixed into a liquid by a pressing means that uses a piezoelectric device or heater.

The ink jet device might be used for forming wire lines of a flat panel display panel and spacers of a liquid crystal display panel. Especially, the ink jet device uses a piezoelectric device that sprays ink without a heating process.

Further, in order to form the wire lines, spacers, etc. of the flat panel display panel, the ink jet device sprays a discharged material such as minute metal particles to form wire lines, ball spacers being a material for forming spacers, etc., thereby forming a wire line pattern and spacer. The discharged material has a solvent mixed thereinto except the minute metal particles and ball spacers that are the material for forming the patterns of the wire line and spacer. The materials for forming the patterns are mixed into the solvent so that they can be sprayed through the ink jet device.

When the material for forming the patterns is the minute metal particles, the discharged material of the ink jet device is composed of a mixture of the minute metal particles a few nanometers m to several hundreds of nanometers in size and the solvent.

When the material for forming the patterns is the ball spacer, the discharged material of the ink jet device is composed of a mixture of the ball spacers of ten micrometers or less and the solvent. More specifically, the ball spacer is made from a material such as polystyrene of 3~15 μm in diameter, etc. The solvent mixed with the ball spacer may be composed of water, isopropyl alcohol IPA, glycerol, etc.

The discharged material is sprayed through a plurality of nozzles, thus a desired pattern is patterned, wherein the desired pattern is directed by a host computer included in the ink jet device.

Referring to FIG. 2, the ink jet device includes a head part 101 including a plurality of nozzles discharging a discharged material; and a storing part 111 for storing the discharged material.

On the other hand, the discharged material for forming the pattern of the wire lines of the flat panel display panel or the spacer of the liquid crystal display panel as described above includes minute particles such as the minute metal particle or the ball spacer. Because the discharged material includes the minute particles and in order to prevent the minute particles included in the discharged material from being precipitated and cohered, the ink jet device includes a second pump 113 and a circulation path 123 between the storing part 111 and the head part 101. The ink jet device according to the present invention further includes: a first cleaning water supplier 147 to supply cleaning water for cleaning the precipitated and adhered minute particles inside of the head part 101 in a reverse direction to the spraying of the discharged material; a maintaining/repairing stage 141 where the head part 101 may be submerged into liquid; and a first discharging part 117 for discharging cleaning water including the minute particles that are precipitated and cohered.

The ink jet device according to the present invention might further include a second cleaning water supplier 115 for supplying the cleaning water for cleaning the precipitated and cohered minute particles in the same direction as the spraying of the discharged material.

Referring to FIG. 2 in conjunction with FIG. 3, the head part 101 includes: a collecting and delivering part 103 connected to a first supply tube 124 that supplies the discharged material supplied from the storing part 111 for accumulating the discharged material; a plurality of chambers 105 connected to the collecting and delivering part 103 to receive the discharged material accumulated at the collecting and delivering part 103; and a plurality of nozzles 109 connected to the plurality of chambers 105 to form a pattern by spraying the discharged material.

The collecting and delivering part 103 sends out the discharged material supplied from the first supply tube 124 to the chambers 105 through a fluid path 107A. Further, the collecting and delivering part 103 might be a stirring means as it is vibrated by a vibrating means so that the discharged material may maintain its uniformity.

The chambers 105 cause the discharged material supplied from the collecting and delivering part 103 to be sent to the nozzle 109 through a fluid path 107B, thereby spraying the discharged material through the nozzle 109. The piezoelectric device is adjacent to each of the chambers 105 in order to spray the discharged material through the nozzle 109. Each of the piezoelectric devices is controlled by the host computer to operate. If the piezoelectric device operates according to the control signal of the host computer, pressure is applied to the inside of the chamber 105, and the discharged material inside the chamber 105 is sprayed through the nozzle 109 by the pressure. A desired pattern may be formed through the sprayed discharged material, and an operator only controls the operation of the piezoelectric device in accordance with the desired pattern.

On the other hand, when using the ink jet device for a long time, the inside of the head part 101 might be contaminated as the minute particles included in the discharged material are precipitated, cohered and adhered. In order to remove the contaminant, an operator firstly closes the first valve 133 installed at a second supply tube 121 which connects the storing part 111 and the first supply tube 124 of the ink jet device, thereby preventing the discharged material from being supplied to the head part 101. Then, the operator opens the second valve 131 installed at the second cleaning supply tube 122 that connects the second cleaning water supplier 115 and the first supply tube 124 so that the cleaning water supplied from the second cleaning water supplier 115 flows to the first supply tube 124 along the second cleaning water supply tube 122. The cleaning water supplied from the second cleaning water supplier 115 is discharged from the head part 101 by flowing along the collecting and delivering part 103 connected to the first supply tube 124, the chamber 105 connected to the collecting and delivering part 103, and the nozzle 109 connected to the chamber 105 through the first supply tube 124. In this way, the cleaning water discharges the contaminant inside of the head part 101 through the head part 101. Further, the direction of discharging the contaminant inside the head part 101 with the cleaning water supplied from the second cleaning water supplier 115 is the same as the direction of discharging the discharged material.

As described above, the contaminant discharged with the cleaning water supplied from the second cleaning supplier 115 is discharged in the direction of discharging the discharged material, thus the contaminant P residing in the corner of the inside of the collecting and delivering part 103 and the chamber 105 that are included in the head part 101 is hard to get rid of. Accordingly, in order to more effectively remove the contaminant of the inside of the head part 101, especially, the contaminant residing in the corner of the inside of the chamber 105 and the collecting and delivering part 103, the ink jet device according to the present invention includes: a first discharging part 117 connected to the head part 101 for discharging the contaminant; a maintaining/repairing stage 141 provided so that the head part 101 may be submerged into liquid; and a first cleaning water supplier 147 for supplying the cleaning water for removing the contaminant in the maintaining/repairing stage 141.

A method of removing the contaminant P residing in the corner inside the chamber 105 and the collecting and delivering part 103 through the first cleaning water supplier 147 will be described.

In order to remove the contaminant P residing in the corner inside the chamber 105 and the collecting and delivering part 103, the operator firstly closes the first and second valves 133, 131. Because the first and second valves 133, 131 are closed, the discharged material flows into the head part 101 or the cleaning water is supplied from the second cleaning water supplier 115 are stopped. Then, the operator puts the head part 101 into the liquid in the maintaining/repairing stage 141, and the cleaning water 155 may be supplied to the maintaining/repairing stage 141 from the first cleaning water supplier 147. In order to supply the cleaning water 155 to the maintaining/repairing stage 141, the maintaining/repairing stage 141 is connected to the first cleaning water supplier 147 through the first cleaning water supply tube 143, and a third valve 151 is installed at the first cleaning water supplier 147. The third valve 151 controls amount of the cleaning water supplied from the first cleaning water supplier 147 to supply the cleaning water to the maintaining/repairing stage 141. The operator opens the third valve 151 so that the cleaning water 155 may be supplied to the maintaining/repairing stage 141. As the third valve 151 is opened, the cleaning water supplied through the cleaning water supplier 147 is supplied to the maintaining/repairing stage 141 through the first cleaning water supply tube 143 to fill the maintaining/repairing stage 141. The cleaning water 155 filled in the maintaining/repairing stage 141 is discharged along with the contaminant P residing in the corner of the inside of the chamber 105 and the collecting and delivering part 103 through the first discharging part 117 connected to the head part 101.

The first discharging part 117 includes: a first discharging tube 125 that is a path for the cleaning water including the contaminant P; a first pump 119 for applying pressure so that the cleaning water 155 of the maintaining/repairing stage 141 can be discharged through the first discharging part 117; and a fourth valve 135 disposed between the first pump 119 and the head part 101.

As described above, if the fourth valve 135 is opened and the first pump 119 is activated when the first and second valves 133, 131 are closed and the head part 101 is submerged into the maintaining/repairing stage 141 filled with the cleaning water 155, the cleaning water 155 is drawn inside the head part 101 by the pressure applied through the first pump 119 of the maintaining/repairing stage 141. The first pump 119 operates until the cleaning water 155 is discharged out of the head part 101 through the first discharging tube 125.

The contaminant P residing in the corner of the inside of the chamber 105 and the collecting and delivering part 103 is discharged along with the cleaning water 155 through the first discharging part 117 because it can float in the cleaning water 155 as the cleaning water 155 filled in the maintaining/repairing stage 141 is discharged in a direction opposite to spraying the discharged material by the operation of the second pump 119.

As described above, the ink jet device according to the present invention may get rid of the contaminant inside the head part 101 using the cleaning water 155. Especially, the cleaning water 155 supplied to the maintaining/repairing stage 141 from the first cleaning water supplier 147 is pumped in the opposite direction of discharging the discharged material by use of the first discharging part 117, thereby making it possible to effectively get rid of the contaminant P residing in the corner of the inside of the chamber 105 and the collecting and delivering part 103.

In this way, the ink jet device according to the present invention gets rid of contaminants in the head part 101 both in the direction of and in the reverse direction of discharging the discharged material, thereby enabling the removal of even the contaminant P residing in the corner of the inside of the chamber 105 and the collecting and delivering part 103. Accordingly, the present invention may improve the life span of the ink jet device and prevent bad patterns from being formed because of a clogged head part 101 caused by contaminants P remaining for a long time in the corner inside the chamber 105 and the collecting and delivering part 103 is prevented.

Further, the ink jet device according to the present invention further includes a second discharging part 149 connected to the maintaining/repairing stage 141.

The second discharging part 149 includes a second discharging tube 145 providing a path for the cleaning water including the contaminant and a fifth valve 153 controlling the flow of the cleaning water. The cleaning water including the contaminant is discharged through the second discharging tube 145.

The ink jet device according to the present invention may be made to open the fifth valve 153 of the second discharging part 149 to discharge the cleaning water including of the contaminant through the second discharging part 149 when getting rid of the contaminant in the direction of discharging the discharged material.

Further, the second discharging part 149 discharges the cleaning water 155 supplied to the maintaining/repairing stage 141 by opening the fifth valve 153, thereby acting to prevent the cleaning water 155 supplied from the maintaining/repairing stage 141 from overflowing the maintaining/repairing stage 141.

On the other hand, the storing part 111 stores the discharged material to supplies the discharged material to the head part 101 when forming the pattern.

The storing part 111 is connected to the second supply tube 121 that provides a passage through which the discharged material may travel, and the second supply tube 121 is connected to the first valve 133 that determines whether or not the discharged material is supplied to the head part 101.

The discharged material stored in the storing part 111 includes the minute particles, thus there is possibility that the minute particles included in the discharged material are precipitated or cohered as a long time passes. In order to prevent the precipitation and cohesion of the minute particles, a circulation path 123 is connected to the storing part 111.

The circulation path 123 is connected between the second supply tube 121 and the storing part 111, thereby providing a stirring action that enables the discharged material stored in the storing part 111 to move freely all the time. The minute particles included in the discharged material are prevented from precipitating or cohering by the circulation path 123 providing a stirring action.

Further, the circulation path 123 might include the first pump 113 providing a driving force so that the discharged material stored at the storing part 111 moves through the circulation path 123.

As described above, the ink jet device according to the present invention includes the first and second cleaning water supplier 147 that supplies the cleaning water 155, thereby making it possible to get rid of the contaminant in the head part 101 in the direction of and in the reverse direction of discharging the discharged material. Thus it is possible to get rid of the contaminant residing in the corner inside the chamber and the collecting and delivering part. Accordingly, the ink jet device according to the present invention prevents the clogging of the head part 111 generated when the contaminant remaining in the corner inside the chamber and the collecting and delivering part 103 is left for a long time. As a result, it is possible that the life span of the ink jet device is improved and the formation of the bad pattern is prevented.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

It will be apparent to those skilled in the art that various modifications and variations may be made in the present invention without departing from the spirit or scope of the invention. Thus, it is intended that the present invention cover the modifications and variations of this invention provided they come within the scope of the appended claims and their equivalents.

What is claimed is:

1. A method of fabricating a liquid crystal display device, An ink jet device, comprising:

a maintaining/repairing stage filled with cleaning water;

a plurality of nozzles to be submerged into the maintaining/repairing stage filled with the cleaning water;

a plurality of chambers connected to the nozzles in a one-to-one relationship, wherein a volume of each chamber is variable by a pressing means;

a supply tube that supplies a discharged material;

a discharging tube that discharges a contaminant and the cleaning water from at least one of the nozzle and the chamber;

a collecting and delivering part connected to the supply tube, the discharging tube and the chambers that supplies the discharged material from the supply tube to the chambers and supplying the contaminant and the cleaning water from the chambers to the discharging tube;

a pump connected to the discharging tube that pumps the contaminant and the cleaning water to the discharging tube; and a second cleaning water supply tube connected to the supply tube that supplies the cleaning water to remove the contaminant from at least one of the supply tube, the collecting and delivering part, the chamber, and the nozzle.

2. The ink jet device according to claim 1, wherein the pressing means includes a piezoelectric device.

3. The ink jet device according to claim 1, wherein the discharged material includes one of minute metal particles and minute ball spacer particles.

4. The ink jet device according to claim 1, further comprising:

a cleaning water supply tube connected to the maintaining/repairing stage that supplies the cleaning water to the maintaining/repairing stage; and a valve installed at the cleaning water supply tube that controls amount of the cleaning water to be supplied to the maintaining/repairing stage.

5. The ink jet device according to claim 1, further comprising:

a second discharge tube connected to the maintaining/repairing stage that discharges the cleaning water; and a valve installed at the second discharging tube that controls an amount of the cleaning water to be discharged.

6. The ink jet device according to claim 1, further comprising:

a valve installed at the second cleaning water supply tube to control an amount of the cleaning water to be supplied from the second cleaning water supply tube.

7. The ink jet device according to claim 1, further comprising:

a storing part connected to the supply tube that stores the discharged material;

a second supply tube that connects the storing part to the supply tube; and a valve installed at the second supply tube that controls the discharge material to be discharged from the storing part.

8. The ink jet device according to claim 1, further comprising:

a circulation path connected between the storing part and the second supply tube; and a pump installed at the circulation path that pumps the discharged material stored in the storing part.

9. A method of cleaning an ink jet device comprising:

submerging an ink jet head including a plurality of nozzles in cleaning water in a maintaining/repairing stage;

pumping the cleaning water through the plurality of nozzles in a direction opposite to a direction that the nozzles spray a discharged material through a discharging tube; and controlling an amount of the cleaning water to be discharge through a second discharging tube.

10. The method of claim 9, wherein the discharged material includes minute metal particles and minute balls spacer particles.

11. The method of claim 9 further including controlling the amount of the cleaning water to be supplied to the maintaining/repairing stage.

12. The method of claim 9 further including circulating the discharge material stored in a storing part.

13. The method of claim 12, wherein circulating the discharge material includes pumping discharge material through a circulation path connected between the storing part and a supply tube.

* * * * *